US008234887B2

(12) United States Patent
Ahn

(10) Patent No.: US 8,234,887 B2
(45) Date of Patent: Aug. 7, 2012

(54) WASHING MACHINE HAVING STEAM GENERATOR

(75) Inventor: In Geun Ahn, Changwon-si (KR)

(73) Assignee: LG Electronics Inc., Seoul (KR)

( * ) Notice: Subject to any disclaimer, the term of this patent is extended or adjusted under 35 U.S.C. 154(b) by 861 days.

(21) Appl. No.: 11/629,385

(22) PCT Filed: Mar. 24, 2006

(86) PCT No.: PCT/KR2006/001104

§ 371 (c)(1),
(2), (4) Date: Feb. 6, 2008

(87) PCT Pub. No.: WO2006/101377

PCT Pub. Date: Sep. 28, 2006

(65) Prior Publication Data

US 2008/0250822 A1 Oct. 16, 2008

(30) Foreign Application Priority Data

Mar. 25, 2005 (KR) ..... 10-2005-0025043

(51) Int. Cl.
*B08B 3/12* (2006.01)
*D06B 23/00* (2006.01)
*D06F 37/00* (2006.01)

(52) U.S. Cl. ..... 68/5 R; 68/3 R; 68/5 C

(58) Field of Classification Search ..... None
See application file for complete search history.

(56) References Cited

U.S. PATENT DOCUMENTS

2004/0244432 A1 12/2004 Kim et al.
2004/0255391 A1* 12/2004 Kim et al. ..... 8/149.3
2005/0034489 A1 2/2005 Oh et al.

FOREIGN PATENT DOCUMENTS

DE 197 43 508 A1 10/1997
EP 1 464 750 A1 10/2004
EP 1 469 120 10/2004

(Continued)

*Primary Examiner* — Michael Barr
*Assistant Examiner* — Jason Ko
(74) *Attorney, Agent, or Firm* — McKenna Long & Aldridge LLP

(57) ABSTRACT

The present invention relates to drum type washing machines, and more particularly, to a new type of steam generator for a drum type washing machine, which enables fast and effective washing and drying of laundry, and can provide a refresh effect of removal of wrinkles form, and sterilization of the laundry. For this, a steam generator (600) includes a steam generating portion (610) having a water supply inlet (612) at one side and an outlet (613) at the other side, and a space (611) between the water supply inlet (612) and the outlet (613), a water supply flow line (620) connected to the water supply inlet (612) for guiding the water to the space, a discharge flow line (630) connected to the outlet (613) for guiding a flow of steam generated at the space, a bypass flow line (660) connected to the water supply flow line (620) for discharging the water overflowing from the steam generating portion (610) in a case water is supplied in a state the outlet (613) and/or the discharge flow line (630) are blocked, and a heater (640) for heating the water supplied through the water supply inlet (612) to generate the steam.

24 Claims, 5 Drawing Sheets

FOREIGN PATENT DOCUMENTS

| | | | |
|---|---|---|---|
| EP | 1 507 033 | | 2/2005 |
| EP | 1507030 | A1 | 2/2005 |
| EP | 1 666 655 | A2 | 6/2006 |
| EP | 1 696 066 | A2 | 8/2006 |
| FR | 2 306 400 | A1 | 4/1976 |
| JP | 61-002226 | | 1/1986 |
| JP | 61-128995 | | 6/1986 |
| JP | 62-199079 | | 12/1987 |
| JP | 63-166182 | | 10/1988 |
| JP | 2003-181392 | | 7/2003 |
| JP | 2003-311084 | | 11/2003 |
| JP | 2003-320324 | | 11/2003 |
| KR | 20-1993-0021684 | | 10/1993 |
| KR | 10-1999-0085040 | | 12/1999 |
| KR | 10-2001-0018295 | | 3/2001 |
| KR | 10-2004-0085507 | | 10/2004 |
| KR | 10-2004-0088885 | | 10/2004 |
| KR | 10-2005-0018182 | | 2/2005 |
| KR | 10-2006-0062407 | | 6/2006 |
| SU | 1481303 | A1 | 1/1987 |

* cited by examiner

[Fig. 1]
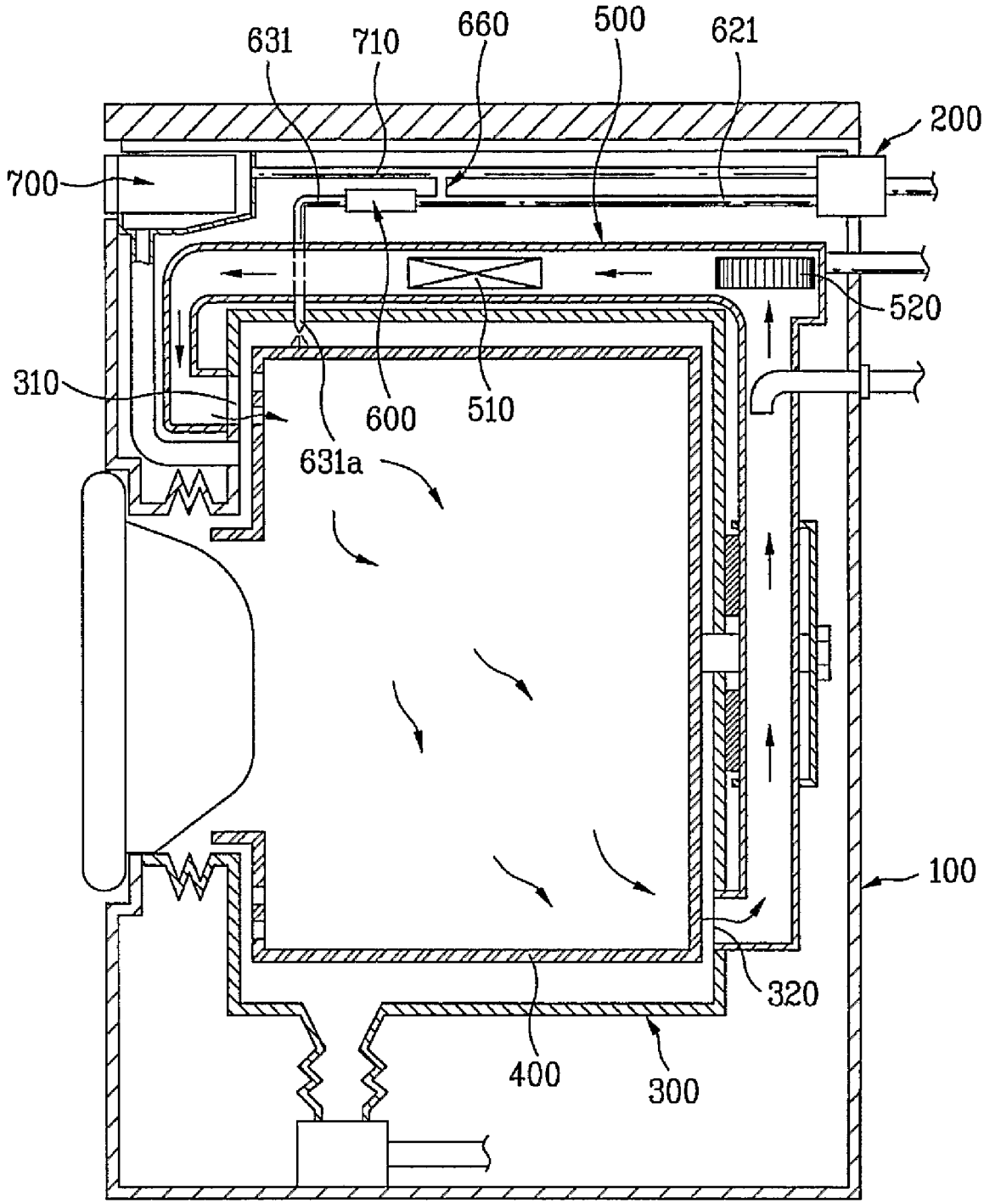

[Fig. 2]
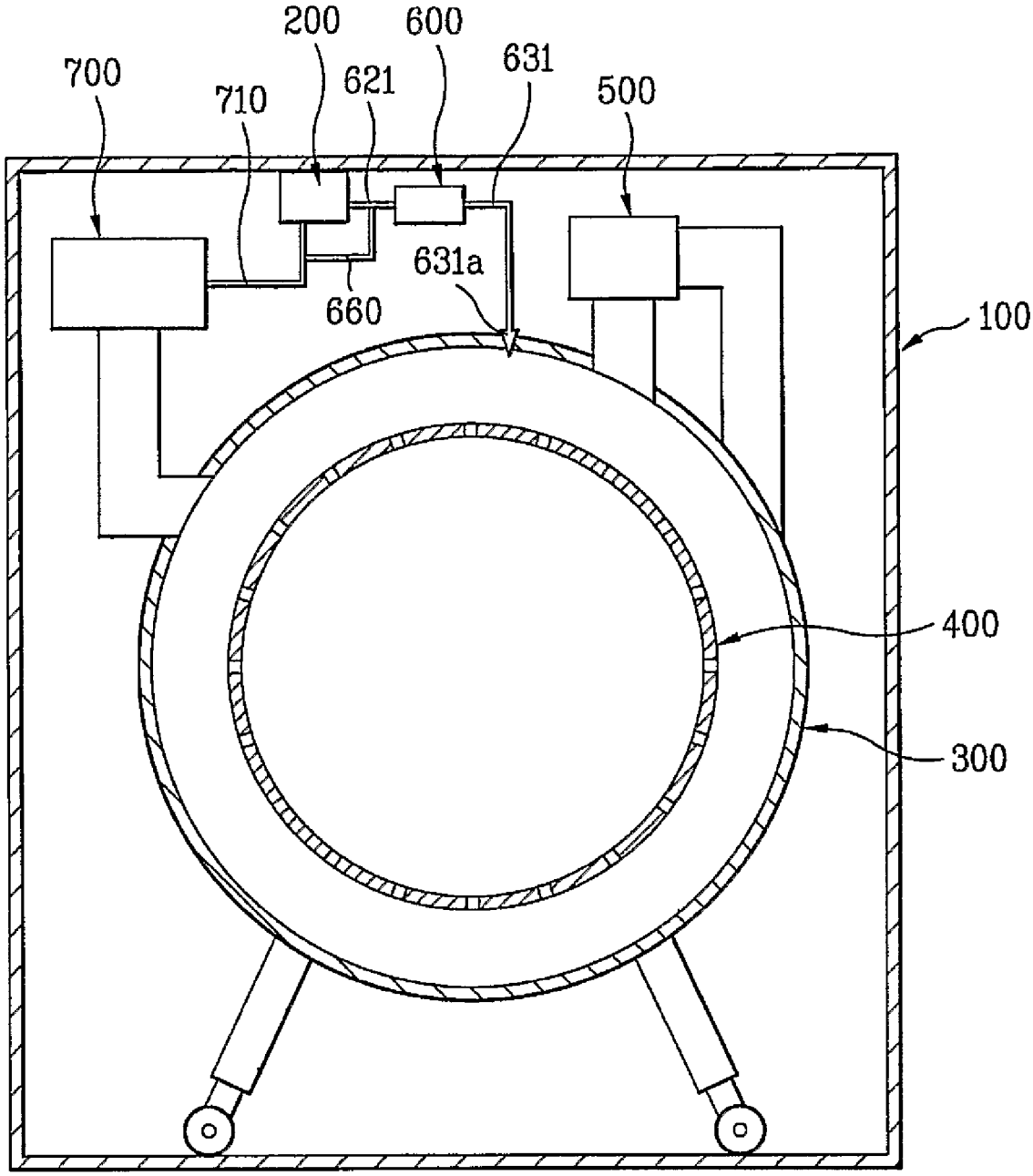

[Fig. 3]
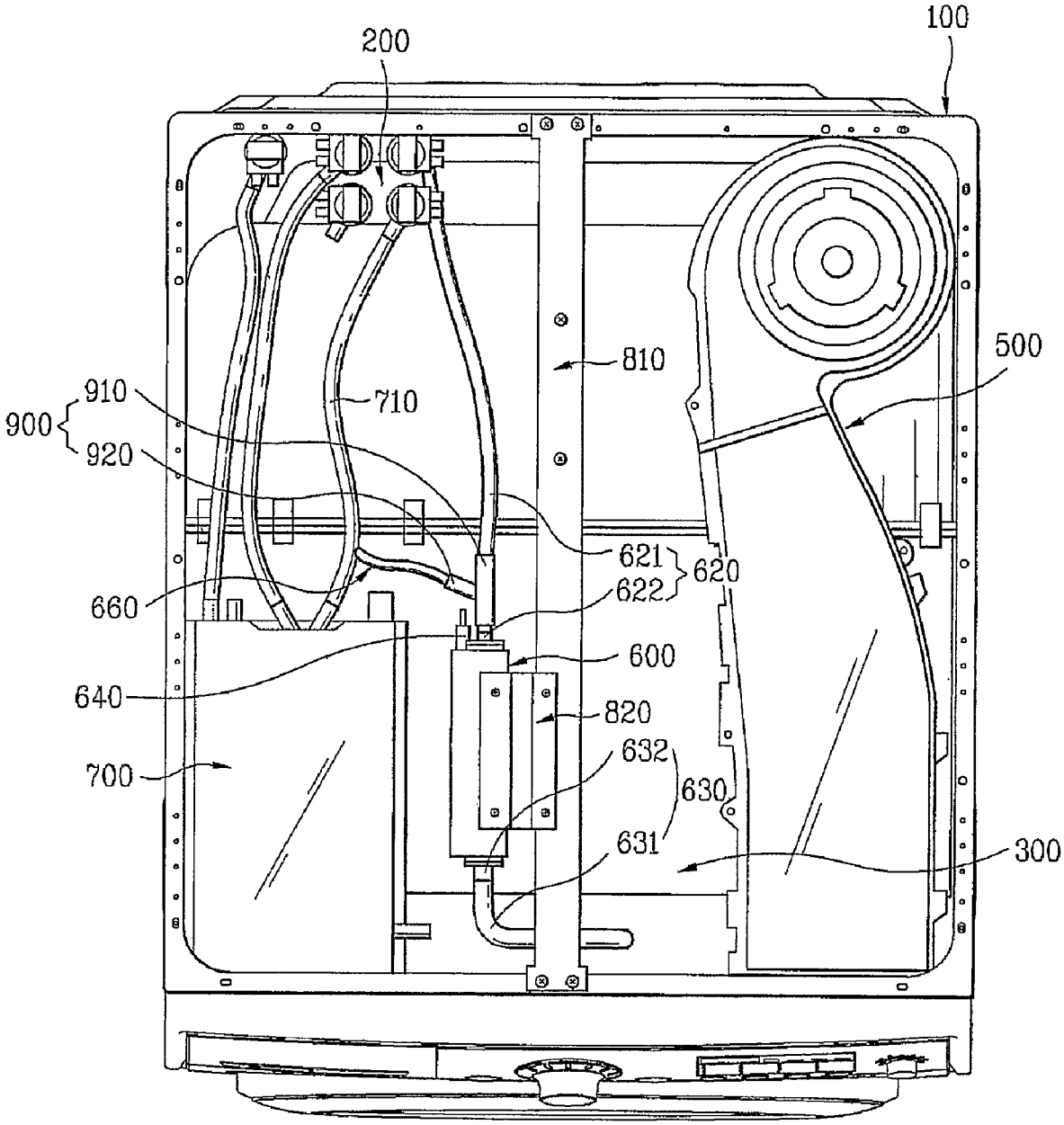

[Fig. 4]
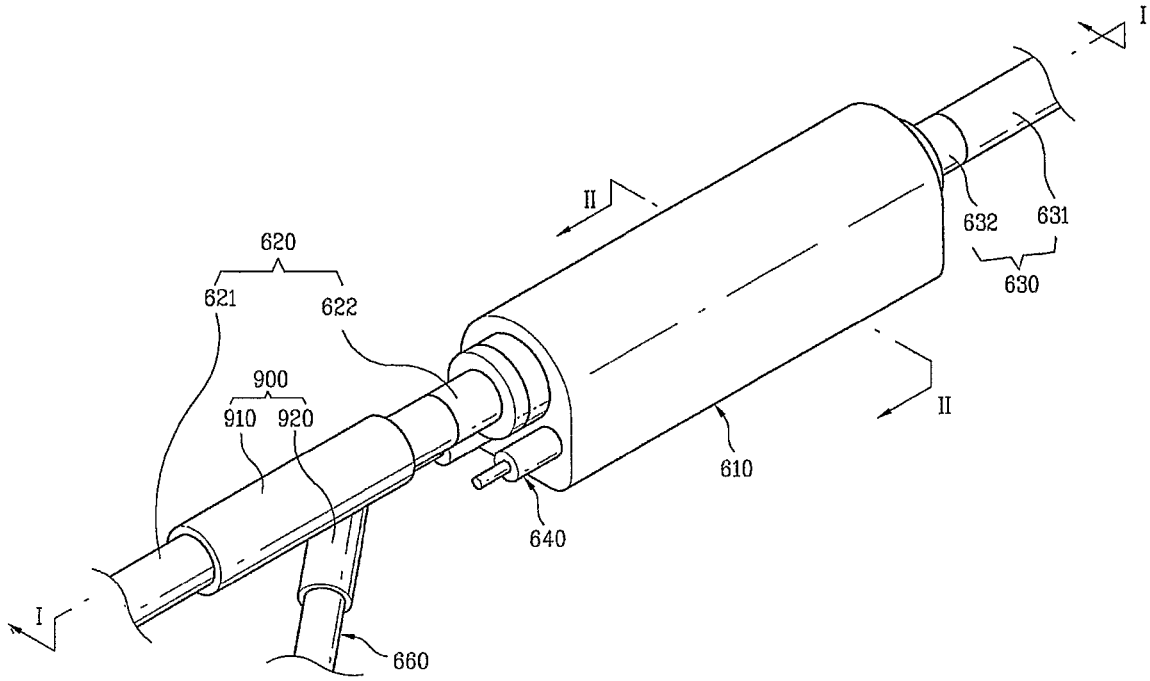
[Fig. 5]
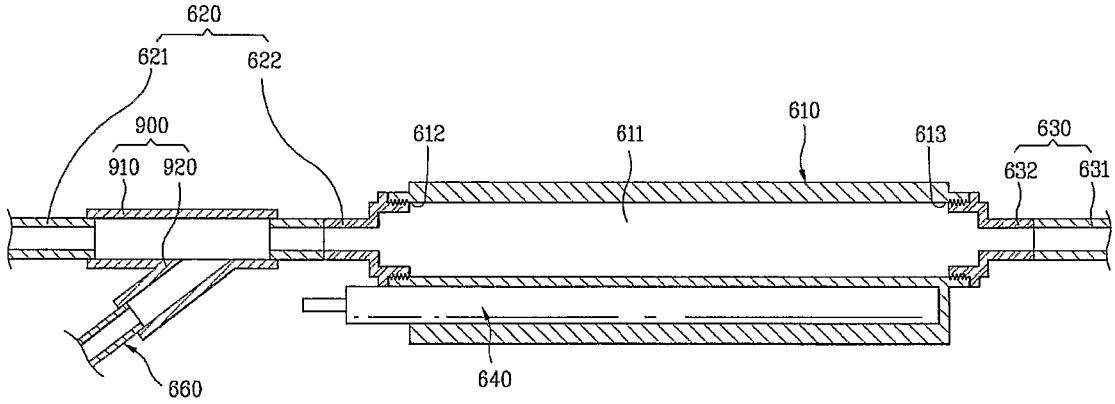

[Fig. 6]
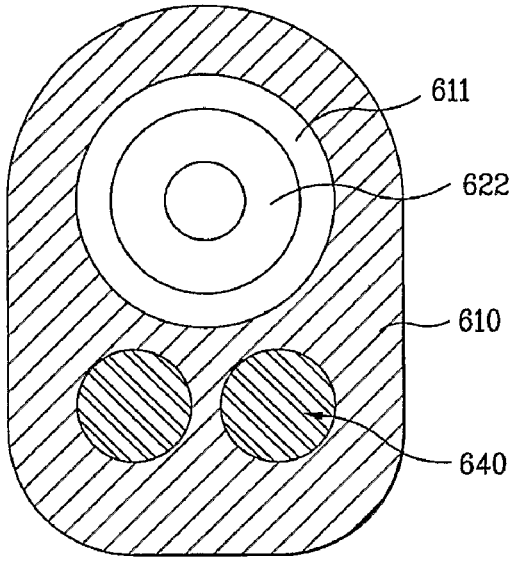
[Fig. 7]
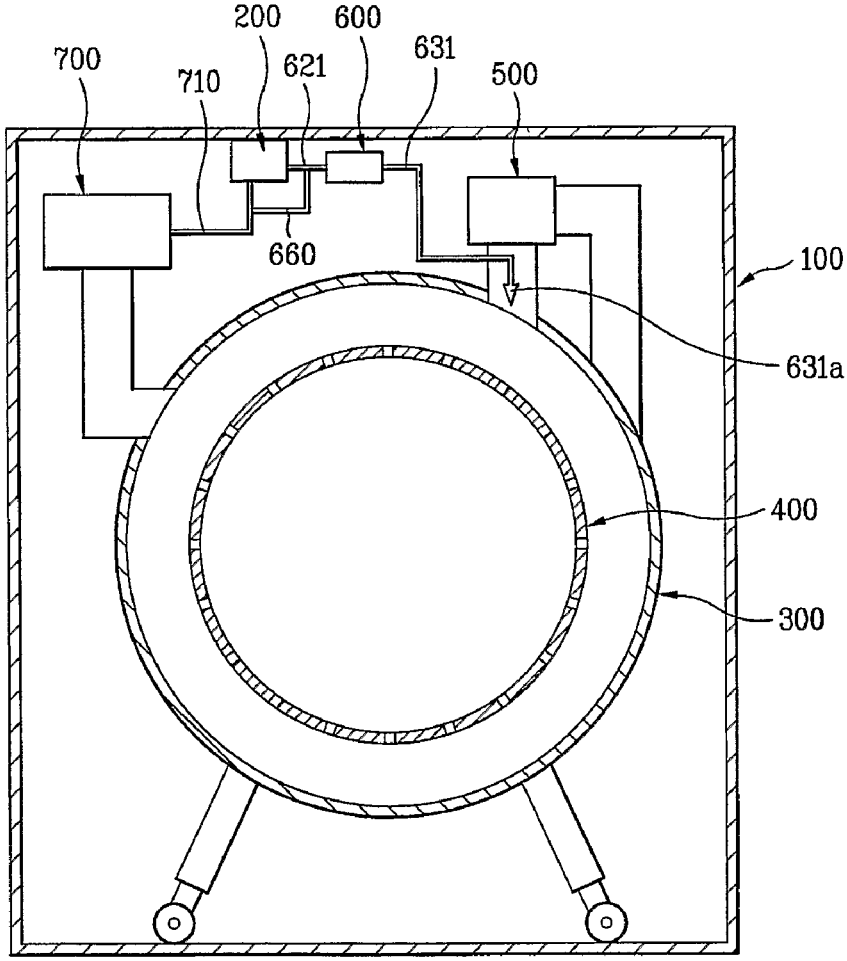

WASHING MACHINE HAVING STEAM GENERATOR

This application claims the benefit of Korean Patent Application No. 2005-0025043, filed on Mar. 25, 2005 and PCT Application No. PCT/KR2006/001104, filed on Mar. 24, 2006, which is hereby incorporated by reference for all purposes as if fully set forth herein.

TECHNICAL FIELD

The present invention relates to drum type washing machines, and more particularly, to a new type of steam generator for a drum type washing machine, which enables fast and effective washing and drying of laundry, and can provide a refresh effect of removal of wrinkles from, and sterilization of the laundry.

BACKGROUND ART

In general, the drum type washing machine washes laundry by using friction between laundry and a drum rotated by driving power of a motor in a state detergent, washing water, and the laundry is introduced to the drum, shows almost no damage to the laundry, and no entangling of the laundry, and can provide a pounding and rubbing washing effect.

A drum type washing and drying machine washes the laundry the same as the drum type washing machine and along with this, even dries the laundry of which washing is finished.

The drum type washing and drying machine dries the laundry by Supplying hot air to the drum through a drying duct having a drying heater and a fan mounted thereon.

However, the related art drum type washing machine has the following problems.

First, the soaking before washing consumes a large amount of washing water.

That is, the wetting with washing water to soak the laundry requires a large amount of water.

Second, no provision for sterilizing the laundry has been provided.

Of course, though not shown, recently, though there is a structure in which a washing water heater is provided to the washing machine separately for heating the washing water, for washing with boiling, since the sterilization of the laundry is male simply by the boiling, the structure is not preferred due to washing water and power consumption required for the boiling.

Third, the lots of wrinkles formed during the washing result in the trouble of requiring separate manual works, such as pressing.

Particularly, despite of the lots of wrinkles on the laundry, if the drying is performed in the drum, the pressing becomes more difficult, leading the consumers to complain.

DISCLOSURE OF INVENTION

Technical Problem

An object of the present invention is to provide a new type of steam generator for a drum type washing machine, which enables fast and effective washing and drying of laundry, and can provide a refresh effect of removal of wrinkles from, and sterilization of the laundry.

Technical Solution

The object of the present invention can be achieved by providing a steam generator for a drum type washing machine including a steam generating portion having a water supply inlet at one side and an outlet at the other side, and a space between the water supply inlet and the outlet, a water supply flow line connected to the water supply inlet for guiding the water to the space, a discharge flow line connected to the outlet for guiding a flow of steam generated at the space, a bypass flow line connected to the water supply flow line for discharging the water overflowing from the steam generating portion in a case water is supplied in a state the outlet and/or the discharge flow line are blocked, and a heater for heating the water supplied through the water supply inlet to generate the steam.

In another aspect of the present invention, a washing machine includes a tub in a body of the washing machine, a drum rotatably mounted in the tub, a drying duct for guiding hot air to the drum, and a steam generator including a steam generating portion having a water supply inlet at one side and an outlet at the other side, and a space between the water supply inlet and the outlet, and a heater for heating the water supplied through the water supply inlet to generate the steam.

In another aspect of the present invention, a washing machine includes a tub in a body of the washing machine, a drum rotatably mounted in the tub, a detergent box for supplying detergent to the drum, a detergent box water supply pipe for guiding water to the detergent box, a drying duct for guiding hot air to the drum, and a steam generator including a steam generating portion having a water supply inlet at one side and an outlet at the other side, and a space between the water supply inlet and the outlet, a water supply flow line connected to the water supply inlet for guiding the water to the space, a discharge flow line connected to the outlet for guiding a flow of steam generated at the space, a bypass flow line connected to the water supply flow line for discharging the water overflowing from the steam generating portion in a case water is supplied in a state the outlet and/or the discharge flow line are blocked, and a heater for heating the water supplied through the water supply inlet to generate the steam.

Advantageous Effects

Thus, the present invention has the following advantages.

First, washing water can be saved while enhancing a washing effect in washing.

Second, not only drying efficiency and drying performance can be improved, but also wrinkles can be removed from the laundry and the laundry can be sterilized.

Third, the refreshing effect of the laundry improves satisfaction of the user.

Fourth, the bypass flow line prevents the steam generating portion from being broken by a water pressure in a case water is supplied thereto in a state the outlet and/or the discharge flow line of the steam generating portion is blocked.

BRIEF DESCRIPTION OF THE DRAWINGS

The accompanying drawings, which are included to provide a further understanding of the invention, illustrate embodiment(s) of the invention and together with the description serve to explain the principle of the invention. In the drawings;

FIG. 1 illustrates a longitudinal section of a drum type washing and drying machine in accordance with a preferred embodiment of the present invention, schematically;

FIG. 2 illustrates a cross section of a drum type washing and drying machine in, accordance with a preferred embodiment of the present invention, schematically;

FIG. 3 illustrates a plan view of a drum type washing and drying machine in accordance with a preferred embodiment of the present invention, schematically;

FIG. 4 illustrates a perspective view of the steam generator in FIG. 3, schematically;

FIG. 5 illustrates a section across a line I-I in FIG. 4;

FIG. 6 illustrates a section across a line II-II in FIG. 4; and

FIG. 7 illustrates a cross section of a drum type washing and drying machine in accordance with a preferred embodiment of the present invention showing another type of a steam supply structure, schematically.

BEST MODE FOR CARRYING OUT THE INVENTION

Reference will now be made in detail to the preferred embodiments of the present invention, examples of which are illustrated in the accompanying drawings.

FIG. 1 illustrates a longitudinal section of a drum type washing and drying machine in accordance with a preferred embodiment of the present invention, schematically, and FIG. 2 illustrates a cross section of a drum type washing and drying machine in accordance with a preferred embodiment of the present invention, schematically.

FIG. 3 illustrates a plan view of a drum type washing and drying machine in accordance with a preferred embodiment of the present invention schematically, FIG. 4 illustrates a perspective view of the steam generator in FIG. 3 schematically, FIG. 5 illustrates a section across a line I-I in FIG. 4, and FIG. 6 illustrates a section across a line II-II in FIG. 4.

In the meantime, FIG. 7 illustrates a cross section of a drum type washing and drying machine in accordance with a preferred embodiment of the present invention showing another type of a steam supply structure, schematically.

Referring to FIGS. 1 and 2, the drum type washing and drying machine in accordance with a preferred embodiment of the present invention includes a body 100 of an exterior of the drum type washing and drying machine, a water supply valve 200 on the body 100 for supplying water from an outside of the drum type washing and drying machine, a substantially cylindrical tub 300 in the body 100 having a hot air inlet 310 and a hot air outlet 320, a drum 400 rotatably mounted in the tub 300, a drying duct 500 having a drying heater 510 for heating air to be supplied to the drum 400 and a fan 520 for forced blowing of hot air heated by the drying heater 510 to the drum 400 built therein, for supplying hot air to the drum 400, and at least one steam generator 600 for supplying steam to the drum 400.

Referring to FIGS. 3 to 6, the steam generator 600 includes a steam generating portion 610 having a space 611 for flow of water and a water supply inlet 612 and an outlet 613 in communication with the space respectively, a water supply flow line 620 connected between the water supply valve 200 and the water supply inlet 612 of the steam generating portion 610, a discharge flow line 630 connected between the outlet 613 of the steam generating portion 610 and the tub 300, a bypass flow line 660 connected to the water supply flow line 620 for discharging water overflowing from the steam generating portion if water is supplied in a state the outlet 612 and/or the discharge flow line 630 is blocked and a heater 640 for fast heating of the water introduced to the space 611 in the steam generating portion 610.

Together with this, the steam generator 600 further includes a temperature sensor (not shown) for sensing a temperature of the steam generating portion 610.

The temperature sensor is provided for controlling the heater 640 according to a temperature of the steam generating portion, and it is preferable that overheating of the heater 640 is prevented in advance by using a thermo-fuse which is to be gone at a temperature higher than a preset temperature to cut off the power to the heater 640.

In the meantime, referring to FIGS. 4 to 6, as the steam generating portion has a tubular shape, the space 611 also has a tubular shape, and the water supply inlet 612 and the outlet 613 of the steam generating portion 610 are formed at opposite ends of the steam generating portion 610.

It is preferable that the steam generating portion 610 is tilted such that the outlet 613 is positioned higher than the water supply inlet 612, for preventing discharge of, not steam, but water through the outlet 613.

In this instance, the space 611 of the steam generating portion 610 has a sectional area greater than a sectional area of the water supply flow line 620 or a sectional area of the discharge flow line 630, for smooth supply of water to the space 611 of the steam generating portion 610, and smoother discharge of the steam from the space 611.

It is preferable that the discharge flow line 630 has a sectional area smaller than the sectional area of the water supply flow line 620.

This is for causing a pressure difference between the discharge flow line 630 and the water supply flow line 620 for smooth discharge of the steam, generated as the water supplied from the water supply flow line 620 flows the space 611 of the steam generating portion 610, to the discharge flow line 630.

In the meantime, it is preferable that the steam generating portion 610 is formed of metal having good conductivity and low density, such as aluminum, by die casting.

The water supply flow line 620 includes a water supply valve 200 (see FIG. 3), a water supply pipe 621 connected to the water supply valve, and a water supply pipe 622 between the water supply pipe 621 and the water supply inlet 612 of the steam generating portion 610.

The discharge flow line 630 includes a discharge pipe 632 provided to the outlet 613 of the steam generating portion 610, and a steam supply pipe 631 between the discharge pipe 632 and the tub 300.

It is preferable that the steam supply pipe 631 has a nozzle shaped end 631*a* for smooth supply of the steam.

In the meantime, referring to FIG. 7, the steam may be supplied to the drum 400 through the drying duct 500 by connecting the steam supply pipe 631 between the outlet 613 of the steam generating portion 610 and the drying duct 500.

That is, the steam supply pipe 631 is connected between the outlet 613 of the steam generating portion 610 and the drying duct 500 for supplying the steam to the drum 400 through the drying duct 500.

In this instance, it is preferable that the steam supply pipe 631 has a steam discharging end 631*a* provided on a side where the hot air is discharged from the drying duct 500.

Moreover, it is preferable that, if the steam is supplied from the steam supply pipe 631 to the drying duct 500, the fan 520 in the drying duct 500 is driven.

This is for preventing the steam from the steam supply pipe 631 from flowing in a direction reverse to a flow direction of the hot air of the drying duct 500.

Of course, if the steam is supplied from the steam supply pipe 631 to the drying duct 500, the steam to the drying duct 500 may be supplied to the drum 400 with the hot air by putting the drying heater 510 into operation at the same time with putting the fan 520 in the drying duct 500 into operation.

The bypass flow line 660 is connected between the water supply flow line 620 of the steam generating portion 610 and a flow line washing water is introduced from the water supply valve 200 to the tub 300, for discharging water overflowing from the steam generating portion.

For an example, if the outlet 613 and/or the discharge flow line 630 are frozen to block the flow due to cold weather, or steam discharge is not smooth due to foreign matter, the bypass flow line 660 permits the water to overflow from the steam generating portion to an outside of the water supply line, to prevent the water from flowing in a reverse direction toward the water supply valve 200.

In the meantime, referring to FIG. 3, there is a detergent box 700 between the water supply valve 200 and the tub 300 for mixing the washing water with detergent and supplying to the tub 300. It is preferable that the bypass flow line 660 is connected to a detergent box water supply line 710 connected between the detergent box 700 and the water supply valve 200.

That is, the bypass flow line 660 is connected between the detergent box water supply line 710 and the water supply pipe 621 of the water supply line 620.

The bypass flow line 660, the water supply pipe 621 of the water supply flow line 620 may be connected with a Y connector 900.

The Y connector 900 may include a water supply guide portion on the water supply pipe 621 of the water supply flow line 620 and a bypass guide portion 920 branched from the water supply guide portion 910 having the bypass flow line 660 connected thereto.

It is preferable that the bypass guide portion 920 is branched from the water supply guide portion 910 in a direction opposite to a direction of a water flow of the water supply pipe 621 of the water supply flow line 620.

This is for smooth overflowing of the water to the bypass guide portion 920 by a pressure difference between the water supply guide portion 910 and the bypass guide portion 920 in the middle of a reverse flow of the water from the space 611 of the steam generating portion 610 toward the Y connector.

Thus, the steam generator 600 of the present invention can prevent the steam generator 600 from being broken down in advance as the water flowing in a reverse direction can be discharged to the bypass flow line 660 connected to the water supply flow line 620 through the Y connector 900 even if the steam discharge flow line is blocked.

In the meantime, though not shown, the bypass flow line 660 may be connected to the detergent box 700 directly, for discharging the water overflowing in a reverse direction from the space of the steam generating portion 610 to the detergent box 700, directly.

Referring to FIGS. 4 to 6 again, it is preferable that the heater 640 of the steam generator 600 is a sheath heater, molded to be buried in the steam generating portion 610 around the space 611 for rapid heating of the water flowing in the space 611.

The heater 640 buried in the steam generating portion 610, so that the heater 640 generates heat to heat the steam generating portion 610 itself of aluminum rapidly for heating the water flowing in the space 611 of the steam generating portion 610, to generate the steam.

In the meantime, referring to FIG. 3, the steam generator 600 is mounted with brackets 810, and 820 separate from the body 100 of the exterior of the drum type washing and drying machine.

That is, the body 100 of the drum type washing and drying machine has the supplementary frame 810 extended in a front/rear direction of the body 100, the supporting bracket 820 at one side is fixed to the supplementary frame 810 at a front side, and the steam generating portion 610 is coupled to the other side of the supporting bracket 820, to mount the steam generator 600 on the body 100 of the drum type washing and drying machine.

In this instance, it is preferable that the steam generating portion 610 is fastened to the other side of the supporting bracket with screws.

That is, though not shown in detail, the steam generating portion 610 has fastening bosses respectively having fastening holes on an upper surface, and the supporting bracket 820 has fastening holes matched to the fastening bosses at the other side, and as the fastening holes and screws are fastened to fastening holes and the fastening bosses, the steam generating portion 610 is coupled to the supporting bracket 820.

For reference, the supplementary frame 810 secured to the body 100 enhances rigidity of the body 100 to reduce vibration and noise taking place when the drum type washing and drying machine performs a cycle, like spinning.

The operation of the steam generator for a drum type washing and drying machine will be described.

The operation of the steam generator when the drum type washing and drying machine washes laundry will be described.

When the drum type washing and drying machine starts washing, the washing water and the detergent is mixed at the detergent box 700, and introduced to the drum 400, and at the same time with this, the steam generator 600 is put into operation, to supply high temperature steam to the drum 400 through the tub 300.

That is, the supply of the hot steam to the drum 400 at an initial stage of the washing makes smooth soaking of the laundry and separation of dirt, to enhance a washing effect even with a small amount of washing water.

In this instance, by turning on the fan 520 and the drying heater 510, to supply hot air to the drum 400 together with the steam, to elevate a temperature of the drum 400 and heat the washing water, the soaking of the laundry and separation of the dirt can be male more quickly and effective.

In the meantime, the steam generator 600 may supply washing water to the drum 400 of the drum type washing and drying machine instead of the steam to shorten a cycle time period in the washing or spinning.

That is, in a case only the washing water required instead of the steam, the steam generator 600 may put into operation in a state power to the heater 640 is turned off, to supply the washing water to the drum 400 even through the steam generator 600.

According to this, as the washing water is supplied through two water supply flow lines connected to the detergent box 700 and the steam generator 600, a time period for receiving the washing water can be reduced thereby permitting to reduce a total cycle time period.

Next, the operation of the steam generator when the drum type washing and drying machine dries laundry will be described.

When the drum type washing and drying machine starts drying of the laundry, power is applied to the drying heater 510 in the drying duct 500, and the fan 520 is operated, to generate hot air in the drying duct 500, and to supply the hot air to the drum 400.

At the same time with this, the steam generator 600 is operated, to generate hot steam and supply the hot steam to the drum 400 through the tub 300.

Then, the hot air and the hot steam generated thus is introduced to the drum 400, to dry the laundry.

That is, in drying the laundry, the hot air as well as the hot steam is supplied to the drum 400, to elevate a temperature of the drum 400, quickly.

Eventually, the laundry in the drum 400 is dried more quickly and sterilized by the hot steam, and has wrinkles thereof unfolded by the hot steam, to provide a refreshing effect.

Next, the operation of the steam generator when the drum type washing and drying machine is in a cycle other than the washing or drying cycle will be described.

If it is intended to perform a separate refresh cycle for unfolding wrinkles of, and sterilizing the laundry other than the washing and the drying, the steam generator 600 generates hot steam and supplies to the drum 400 through the tub 300.

That is, instead of the washing dr drying, by only supplying hot steam to the laundry, the laundry has the wrinkles removed therefrom and is sterilized.

Eventually, not only the wrinkles on the laundry can be minimized more conveniently, but also hygienic laundry can be obtained which improves satisfaction of the consumers.

It is preferable that, in a case the steam generator 600 is operated in the washing, drying, or refreshing of the drum type washing and drying machine, it is preferable that the drum 400 is rotated to supply the steam from the steam generator 600 to the laundry, uniformly.

In the meantime, if water is being supplied to the steam generating portion 610 in a state the outlet 613 and/or the discharge flow line 830 is blocked the water overflows from the steam generating portion 610 to the detergent box 700 through the bypass flow line 660.

According to this, a reverse flow of the water overflowing from the steam generating portion 610 toward the water supply valve 200 can be prevented and breakage of the steam generating portion 610 and the water supply valve 200 caused by a water pressure flowing to the steam generating portion 610 through the water supply valve 200 can be prevented in advance.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

INDUSTRIAL APPLICABILITY

The present invention has an industrial applicability since washing water can be saved while a washing effect is enhanced in washing, and drying efficiency, and performance can be improved, wrinkles on the laundry can be minimized more conveniently, and hygienic laundry can be obtained to improve consumers satisfaction.

Moreover, the present invention also has an industrial applicability since the refreshing effect of the laundry improves satisfaction of the users, and the possibility of the disposal of the overflowing water from the steam generating portion enables to prevent the water supply valve and the steam generating portion from breaking.

The invention claimed is:

1. A steam generator for a laundry machine comprising:

a steam generating portion having:

a water supply inlet at one side and an outlet at another side, and a space between the water supply inlet and the outlet;

a water supply flow line in fluid communication with the water supply inlet to guide water to the space from a water supply valve;

a discharge flow line in fluid communication with the outlet to guide a flow of steam generated at the space;

a bypass flow line connected to the water supply flow line in an upstream position of the steam generating portion to prevent the water from flowing in a reverse direction toward the water supply valve through the water supply flow line when the outlet or the discharge flow line is blocked; and a heater to heat the water supplied through the water supply inlet to generate the steam.

2. The steam generator as claimed in claim 1, wherein the water supply flow line includes a first water supply pipe and a second supply pipe between the first water supply pipe and the water supply inlet.

3. The steam generator as claimed in claim 2, further comprising a Y connector connected between the bypass flow line and the water supply flow line.

4. The steam generator as claimed in claim 3, wherein the Y connector has a bypass guide portion that is projected in a direction opposite to a direction of the water flowing toward the water supply flow line.

5. The steam generator as claimed in claim 1, wherein the steam generating portion is tubular.

6. The steam generator as claimed in claim 1, wherein the space of the steam generating portion has a sectional area that is greater than both a sectional area of the water supply flow line and a sectional area of the discharge flow line.

7. The steam generator as claimed in claim 1, wherein the sectional area of the discharge flow line is smaller than the sectional area of the water supply flow line.

8. The steam generator as claimed in claim 1, wherein the steam generating portion is formed; by die casting.

9. The steam generator as claimed in claim 1, further comprising a water supply valve to regulate a supply of water to the steam generating portion.

10. The steam generator as claimed in claim 5, wherein the water supply inlet and the outlet of the steam generating portion are formed at opposite ends of the steam generating portion.

11. The steam generator as claimed in claim 1, wherein the heater is a sheath heater.

12. The steam generator as claimed in claim 1, wherein the heater is buried adjacent to the space of the steam generating portion by molding.

13. A laundry machine comprising:

a tub;

a drum rotatably mounted in the tub;

a flow line to introduce washing water to the tub; and a steam generator including:

a steam generating portion having a water supply inlet at one side, an outlet at another side, and a space between the water supply inlet and the outlet;

a water supply flow line in fluid communication with the water supply inlet to guide the water to the space independently from the flow line;

a discharge flow line in fluid communication with the outlet to guide a flow of steam generated at the space;

a bypass flow line connected between the water supply flow line and the flow line, wherein one end of the bypass flow line is connected to the water supply flow line in an upstream position of the steam generating portion; and a heater for heating the water supplied through the water supply inlet to generate the steam.

14. The laundry machine as claimed in claim 13, further comprising:

a detergent box; and a detergent box water supply pipe to guide water into the detergent box, wherein the bypass flow line is in fluid communication with the detergent box or the detergent box water supply pipe.

15. The laundry machine as claimed in claim 13, wherein the water supply flow line includes a first water supply pipe and a second supply pipe between the first water supply pipe and the water supply inlet.

16. The laundry machine as claimed in claim 13, wherein the steam generating portion is mounted to an inside of the laundry machine with a bracket.

17. The laundry machine as claimed in claim 13, further comprising a drying duct to guide hot air into the drum, wherein the discharge flow line is in fluid communication with the drying duct, to guide steam from the steam generating portion to the drying duct.

18. The laundry machine as claimed in claim 17, wherein the discharge flow line includes;

a discharge pipe connected to the outlet of the steam generating portion, and a steam supply pipe having one end in fluid communication with the discharge pipe and the other end in fluid communication with the drying duct, to guide the steam from the discharge pipe to the drying duct.

19. A laundry machine comprising:

a drum rotatably mounted in the machine;

a water supply valve; and a steam generator including:

a steam generating portion having a water supply inlet at one side, an outlet at another side, and a space between the water supply inlet and the outlet;

a water supply flow line in fluid communication with the water supply inlet to guide the water to the space from the water supply valve;

a discharge flow line in fluid communication with the outlet to guide a flow of steam generated at the space;

a bypass flow line connected to the water supply flow line in an upstream position of the steam generating portion to prevent the water from flowing in a reverse direction toward the water supply valve through the water supply flow line when the outlet or the discharge flow line is blocked; and a heater for heating the water supplied through the water supply inlet to generate the steam.

20. The laundry machine as claimed in claim 19, wherein the water supply flow line includes a first water supply pipe connected to the water supply valve.

21. The laundry machine as claimed in claim 20, wherein the water supply flow line further includes a second water supply pipe between the first water supply pipe and the water supply inlet.

22. The laundry machine as claimed in claim 20, further comprises a flow line to introduce washing water to a tub independently from the water supply flow line.

23. The laundry machine as claimed in claim 22, wherein the bypass flow line is connected between the water supply flow line and the flow line.

24. The laundry machine as claimed in claim 19, wherein the water supply inlet and the outlet of the steam generating portion are formed at opposite ends of the steam generating portion.

* * * * *